US009418668B2

(12) United States Patent
Van Dongen

(10) Patent No.: US 9,418,668 B2
(45) Date of Patent: Aug. 16, 2016

(54) MATRIX ENCODER WITH IMPROVED CHANNEL SEPARATION

(75) Inventor: Charlie Van Dongen, Frankston (AU)

(73) Assignee: REALITY IP PTY LTD, Caulfield, Victoria (AU)

( * ) Notice: Subject to any disclaimer, the term of this patent is extended or adjusted under 35 U.S.C. 154(b) by 332 days.

(21) Appl. No.: 14/124,161

(22) PCT Filed: Jun. 4, 2012

(86) PCT No.: PCT/AU2012/000631
§ 371 (c)(1),
(2), (4) Date: Feb. 10, 2014

(87) PCT Pub. No.: WO2012/167302
PCT Pub. Date: Dec. 13, 2012

(65) Prior Publication Data

US 2014/0192987 A1 Jul. 10, 2014

(30) Foreign Application Priority Data

Jun. 6, 2011 (AU) ..... 2011902227

(51) Int. Cl.
*H04R 5/00* (2006.01)
*G10L 19/008* (2013.01)
*H04S 3/02* (2006.01)

(52) U.S. Cl.
CPC ..... *G10L 19/008* (2013.01); *H04S 3/02* (2013.01); *H04S 2400/01* (2013.01)

(58) Field of Classification Search
CPC ..... G10L 19/008; H04S 3/02; H04S 2400/01
USPC ..... 381/22, 23
See application file for complete search history.

(56) References Cited

U.S. PATENT DOCUMENTS 3,825,684 A 7/1974 Ito et al.
7,107,211 B2 * 9/2006 Griesinger ..... H04S 3/02 381/20

* cited by examiner

*Primary Examiner* — Paul S Kim

(57) ABSTRACT

An encoder is disclosed for use in a surround sound system wherein at least four audio input signals (FL, FR, RL, RR) representing an original sound field are encoded into two channel signals (L, R) and the encoded two channel signals are decoded into at least four audio output signals (FL', FR', RL', RR') corresponding to the four audio input signals. The encoder includes matrix means connected to receive the four audio input signals for encoding the four input signals into two channel (L and R) output signals. The matrix means includes means responsive to the four input signals for producing $L_{enc}$ and $R_{enc}$ output signals as follows: $L_{enc}$=FL+kFR+jRL+jkRR $R_{enc}$=FR+kFL−jRR−jkRL wherein k denotes a transformation or matrix coefficient having a value that is steered dynamically based on level of rear signal (RL+RR) content relative to front signal (FL+FR) content. An encoding method for use in a surround sound system is also disclosed.

11 Claims, 9 Drawing Sheets

MATRIX ENCODER WITH IMPROVED CHANNEL SEPARATION

CROSS REFERENCE TO RELATED APPLICATION

The present invention is related to the following international patent application assigned to the present applicant the disclosure of which is incorporated herein by cross reference:

PCT/AU2010/001666—IMPROVED MATRIX DECODER FOR SURROUND SOUND

FIELD OF THE INVENTION

The present invention relates to an improved matrix encoder for surround sound. The matrix encoder may be associated with a surround sound system wherein at least four audio input signals representing an original sound field are encoded into two channels and the two channels are decoded into at least four channels corresponding to the four audio input signals.

BACKGROUND OF THE INVENTION

In a multi-channel system as described above four channels of audio signals are obtained from an original sound field and are encoded by an encoder into two channels. The encoded two channels may be recorded on recording media such as CD, DVD or the like or broadcast via stereo TV or FM radio. The encoded two channels may be reproduced from the recording media or broadcast and decoded by means of a matrix decoder back into four channels approximating the four channels of audio signals obtained from the original sound field. The decoded signals may be applied to four speakers to reproduce the original sound field through suitable amplifiers.

To facilitate an understanding of the present invention the principles of a "4-2-4" matrix playback system and a conventional encoder is described below with reference to FIGS. 1 and 2 of the accompanying drawings.

In the system shown in FIG. 1, four microphones 10, 11, 12 and 13 are installed in an original sound field 14 in order to produce four channel audio signals FL (front-left), FR (front-right), RL (rear-left) and RR (rear-right) respectively. An optional centre channel may also be produced. The four channel audio signals are supplied to encoder 15 to be transformed or encoded into two signals L and R. The outputs L and R from encoder 15 are applied to a decoder 16 to be transformed or decoded into reproduced four channel signals FL', FR', RL' and RR' approximating the original four channel signals FL, FR, RL and RR. Decoder 16 may include single or multi-band processing as described below. The reproduced four channel signals may be applied through amplifiers (not shown) to four loud speakers 17, 18, 19 and 20 located in a listening space 21 to provide a multi-channel sound field that more closely approximates the original sound field 14 when compared to a prior art two channel system.

A variety of two channel systems 22 including CD, DVD, TV, FM radio, etc. may be used to capture or store outputs L and R from encoder 15 and to supply the captured or stored outputs to decoder 16. In one example outputs L and R from encoder 15 may be recorded on a storage medium such as a CD, DVD or magnetic tape and the outputs from the storage medium may be applied to decoder 16. According to another example the outputs L and R from encoder 15 or the outputs reproduced from the recording medium may be transmitted to decoder 16 via a stereo TV or an FM stereo radio broadcasting system.

Examples of a conventional encoder 15 include Q sound, Prologic or conventional stereo. Encoder 15 in FIG. 1 may be configured as shown in FIG. 2 wherein audio signals FL and FR produced by microphones 10 and 11 disposed in the front of original sound field 14, and audio signals RL and RR produced by microphones 12, 13 disposed in the rear of original sound field 14 are applied to a conventional matrix circuit 23.

Matrix circuit 23 includes a plurality of adders/multipliers and phase shifters arranged to produce L and R output signals as follows:

$$L=FL+kFR+jRL+jkRR$$

$$R=FR+kFL-jRR-jkRL$$

wherein k denotes a transformation or matrix coefficient generally having a value approximately 0.414 and j denotes a 90 degree phase shift. The phase shifters may provide a substantially consistent phase shift over the entire audio frequency band. The four channel signals FL', FR', RL' and RR' may be reproduced by a conventional decoder having the same matrix coefficient k. It may be shown that when matrix coefficient k=0.414, separations between channel FL' and adjacent channels FR' and RL' are respectively equal to −3 dB and separation between the channels FL' and RR' in a diagonal direction equals −.infin. dB. Because the separation between adjacent channels equals −3 dB it is not possible to enjoy stereo playback of four channels with a sufficiently large directional resolution.

FIG. 3 shows a block diagram of a decoder including a variable matrix 24 having control unit 25 and decoder unit 26 and employing matrix coefficients SL, SR, SF, SB the magnitudes of which may be controlled in accordance with the phase difference between two channel signals L and R.

In the decoder shown in FIG. 3, the two channel signals L and R are applied to input terminals 27 and 28 of the decoder from a two-channel media source and hence to input terminals 29 and 30 of variable matrix 24. Input terminals 27 and 28 are also coupled to input terminals 31 and 32 of variable matrix 24 via 90 degree phase shift circuit 33. Variable matrix 24 operates to decode or dematrix the two channel signals L and R to produce four channel signals at its output terminals 34, 35, 36 and 37. Control unit 25 provides steering control signals SL, SR, SF, and SB to decoder unit 26 in accordance with the phase difference between two-channel signals L and R. The magnitudes of the steering control signals SL, SR, SF, and SB from control unit 25 may vary in opposite directions in proportion to the phase difference between signals L and R. Control signal SF may be used to control the matrix coefficient related to the front channels and control signal SB may be used to control the matrix coefficient related to the rear channels. Similarly control signal SR may be used to control the matrix coefficient related to the right channels and control signal SL may be used to control the matrix coefficient related to the left channels. Where the phase difference between signals L and R is near zero, for instance, the control signal SF operates to decrease the matrix coefficient related to the front channels thus enhancing separation between the front channels. On the other hand, control signal SB operates to increase the matrix coefficient related to the rear channels to reduce separation between rear channels. Concurrently therewith signal levels of the front channels may be increased and those of the rear channels may be decreased to improve separation between the front and rear channels.

The control unit 25 may include a phase discriminator for detecting a phase difference between signals L and R or a comparator for detecting a phase relationship between signals L and R in terms of the difference in the levels of a sum signal (L+R) and a difference signal (L−R). A reason for controlling the matrix coefficient associated with the front and rear channels by detecting the phase relationship between signals L and R is that humans have a keen sensitivity to detect the direction of a large sound but sensitivity for a small sound coexisting with the large sound may be relatively poor. Consequently, where there is a large sound in the front and a small sound in the rear playback of four channels may be more efficient if separation between the front channels is enhanced and separation between the rear channels is reduced. In contrast, where a small sound exists in the front and a large sound in the rear playback of four channels may be more efficient if separation between the rear channels is enhanced and separation between the front channels is reduced.

Where a large sound is present in the front and a small sound is present in the rear, that is, where FL, FR>>RL, RR, signals L and R may have substantially the same phase. This means that the level of a sum signal (L+R) may be higher than that of a difference signal (L−R).

Conversely, where a large sound is present in the rear while a small sound is present in the front, that is, where FL, FR<<RL, RR, signals L and R have opposite phase. In such a case, the level of the sum signal (L+R) may be lower than the level of the difference signal (L−R). For this reason, it may be possible to detect phase relationship between signals L and R by either a phase discriminator or a comparator.

A variable matrix decoder is described in international patent application PCT/AU2010/001666 assigned to the present applicant. The decoder with its intelligent tri band steering systems may achieve approximately 40 db channel separation between all decoded surround outputs on dynamic music content. One disadvantage of the decoder is that stereo encoded media lacks full left/right channel separation and sounds somewhat narrowed.

In pre digital (CD) days it was commonly accepted that 20 db separation was desirable so no crosstalk could be heard. However up to 100 db separation is achievable with modern digital technology. Nevertheless the question still persists as to what level of separation is acceptable to be undetectable in practical terms by human hearing under typical music conditions.

Contrary to common belief, the direction from which sound arrives is perceived by the human ear based on both arrival time and loudness, not loudness alone. This is a psychoacoustic phenomenon known as the "HAAS" or "precedence" effect and is illustrated by a curve as shown in FIG. 4. For wave fronts with arrival time differences in a range of 1-30 milliseconds, and sound pressure level differences of up to 12 db, arrival time is the dominant determinant of perceived sound direction. This is the region underneath the curve. Hence sound is perceived as coming from the direction of a first wave front to arrive, even if the first wave front may be up to 12 db lower in sound pressure level than a later wave front. The Haas curve basically suggests that 12 db signal level difference is required to overcome time delay clues of left/right image positioning. When a separation of 12 db was tested compared to the 100 db available with modern CD technology it was found that listeners could not pick any difference.

When the encoder shown in FIG. 2 is used there is an excess of surround separation amounting to about 40 db. What is needed is more optimum point where the encoded stereo achieves at least 12 db separation between channels, since for the reason explained above the listener may not be able to distinguish the difference even if channel separation was infinite.

Given that a transformation or matrix coefficient in the encoder of 0.414 represents only 6 db of stereo separation in the encoded media, it should be possible to reduce this matrix coefficient to give 12 db separation in the encoded signal.

The present invention may provide a matrix encoder having improved separation between respective channels including between front and rear channels and between left and right channels.

SUMMARY OF THE INVENTION

According to one aspect of the present invention there is provided an encoder for use in a surround sound system wherein at least four audio input signals (FL, FR, RL, RR) representing an original sound field are encoded into two channel signals (L, R) and said encoded two channel signals are decoded into at least four audio output signals (FL', FR', RL', RR') corresponding to said four audio input signals, said encoder including: matrix means connected to receive said four audio input signals for encoding said four input signals into two channel (L and R) output signals, said matrix means including means responsive to said four input signals for producing L and R output signals as follows:

$$L=FL+kFR+jRL+jkRR$$

$$R=FR+kFL-jRR-jkRL$$

wherein k denotes a transformation or matrix coefficient having a value substantially 0.207 and j denotes a 90 degree phase shift.

According to a further aspect of the present invention there is provided an encoder for use in a surround sound system wherein at least four audio input signals (FL, FR, RL, RR) representing an original sound field are encoded into two channel signals (L, R) and said encoded two channel signals are decoded into at least four audio output signals (FL', FR', RL', RR') corresponding to said four audio input signals, said encoder including: matrix means connected to receive said four audio input signals for encoding said four input signals into two channel (L and R) output signals, said matrix means including means responsive to said four input signals for producing $L_{enc}$ and $R_{enc}$ output signals as follows:

$$L_{enc}=FL+kFR+jRL+jkRR$$

$$R_{enc}=FR+kFL-jRR-jkRL$$

wherein k denotes a transformation or matrix coefficient having a value that is steered dynamically based on level of rear signal (RL+RR) content relative to front signal (FL+FR) content.

Coefficient k may be steered from a first value to a second value. The coefficient k may be steered between the first and second values substantially linearly. The coefficient k may have a first value that is substantially 0.1. The coefficient k may have a second value that is substantially 0.414.

According to a still further aspect of the present invention there is provided an encoding method for use in a surround sound system wherein at least four audio input signals (FL, FR, RL, RR) representing an original sound field are encoded into two channel signals (L, R) and said encoded two channel signals are decoded into at least four audio output signals (FL', FR', RL', RR') corresponding to said four audio input signals, said method including: processing said four audio input signals into two channel (L and R) output signals by matrix means responsive to said four input signals for producing L and R output signals as follows:

$$L=FL+kFR+jRL+jkRR$$

$$R=FR+kFL-jRR-jkRL$$

wherein k denotes a transformation or matrix coefficient having a value substantially 0.207 and j denotes a 90 degree phase shift.

According to a still further aspect of the present invention there is provided an encoding method for use in a surround sound system wherein at least four audio input signals (FL, FR, RL, RR) representing an original sound field are encoded into two channel signals (L, R) and said encoded two channel signals are decoded into at least four audio output signals (FL', FR', RL', RR') corresponding to said four audio input signals, said method including: processing said four audio input signals into two channel (L and R) output signals by matrix means responsive to said four input signals for producing $L_{enc}$ and $R_{enc}$ output signals as follows:

$$L_{enc}=FL+kFR+jRL+jkRR$$

$$R_{enc}=FR+kFL-jRR-jkRL$$

wherein k denotes a transformation or matrix coefficient and wherein said processing includes steering the value of coefficient k based on level of rear signal (RL+RR) content relative to front signal (FL+FR) content.

Coefficient k may be steered from a first value to a second value. The coefficient k may be steered between the first and second values substantially linearly. The coefficient k may have a first value that is substantially 0.1. The coefficient k may have a second value that is substantially 0.414.

The matrix means may include a plurality of components selected from adders, multipliers, 90° phase shifters and comparators.

DESCRIPTION OF A PREFERRED EMBODIMENT

A preferred embodiment of the present invention will now be described with reference to the accompanying drawings wherein.

Figure 5:
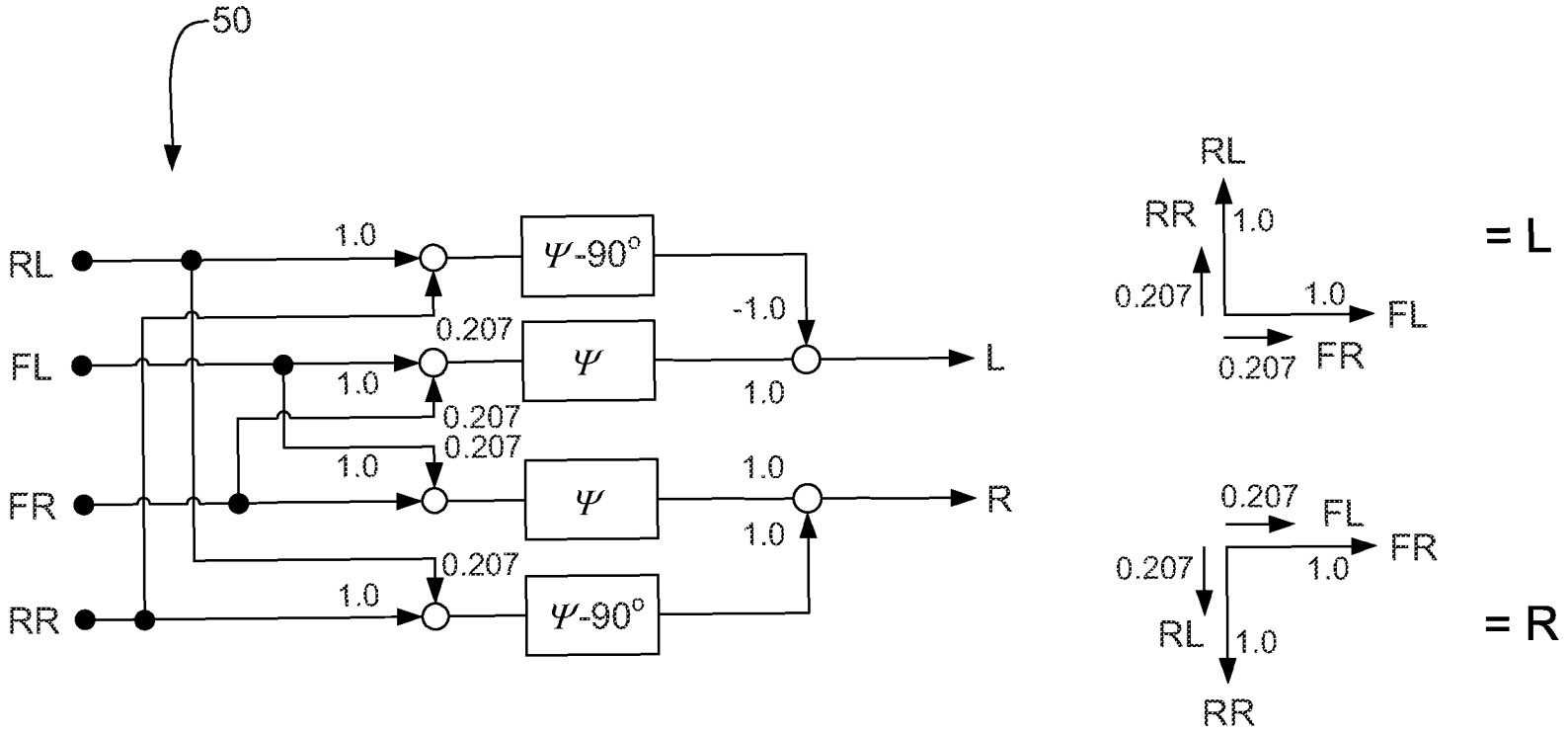
FIG. 5 shows a configuration of an encoder according to an embodiment of the present invention.

FIG. 5 shows a matrix circuit 50 that is adapted to provide 12 dB separation between decoded channels. Matrix circuit 50 includes a plurality of adders/multipliers and phase shifters arranged to produce encoded L and R output signals as follows:

$$L=FL+kFR+jRL+jkRR$$

$$R=FR+kFL-jRR-jkRL$$

wherein k denotes a transformation or matrix coefficient generally having a value approximately 0.207 and j denotes a 90 degree phase shift. The phase shifters may provide a substantially consistent phase shift over the entire audio frequency band. The four channel signals FL', FR', RL' and RR' may be reproduced by a conventional decoder as described in PCT application AU 2010/001666.

It may be shown that when matrix coefficient k=0.207, separation between the encoded stereo L and R output signals is equal to at least 12 db. In addition, separations between decoded channel FL' and adjacent channels FR' and RL' are respectively equal to 12 dB and separation between the channels FL' and RR' in a diagonal direction equals infinity. This makes the system more balanced with no separation bias in the encoded and decoded signals.

Testing performed with the full decoder described in PCT/AU2010/001666 resulted in 12 db separation in the 4 surround output signals. Listeners could not hear a difference during the testing between the 12 db matrix and the 40 db matrix or discrete surround sound. In addition listeners also could not hear a difference between the encoded surround stereo and normal stereo.

Figure 6:
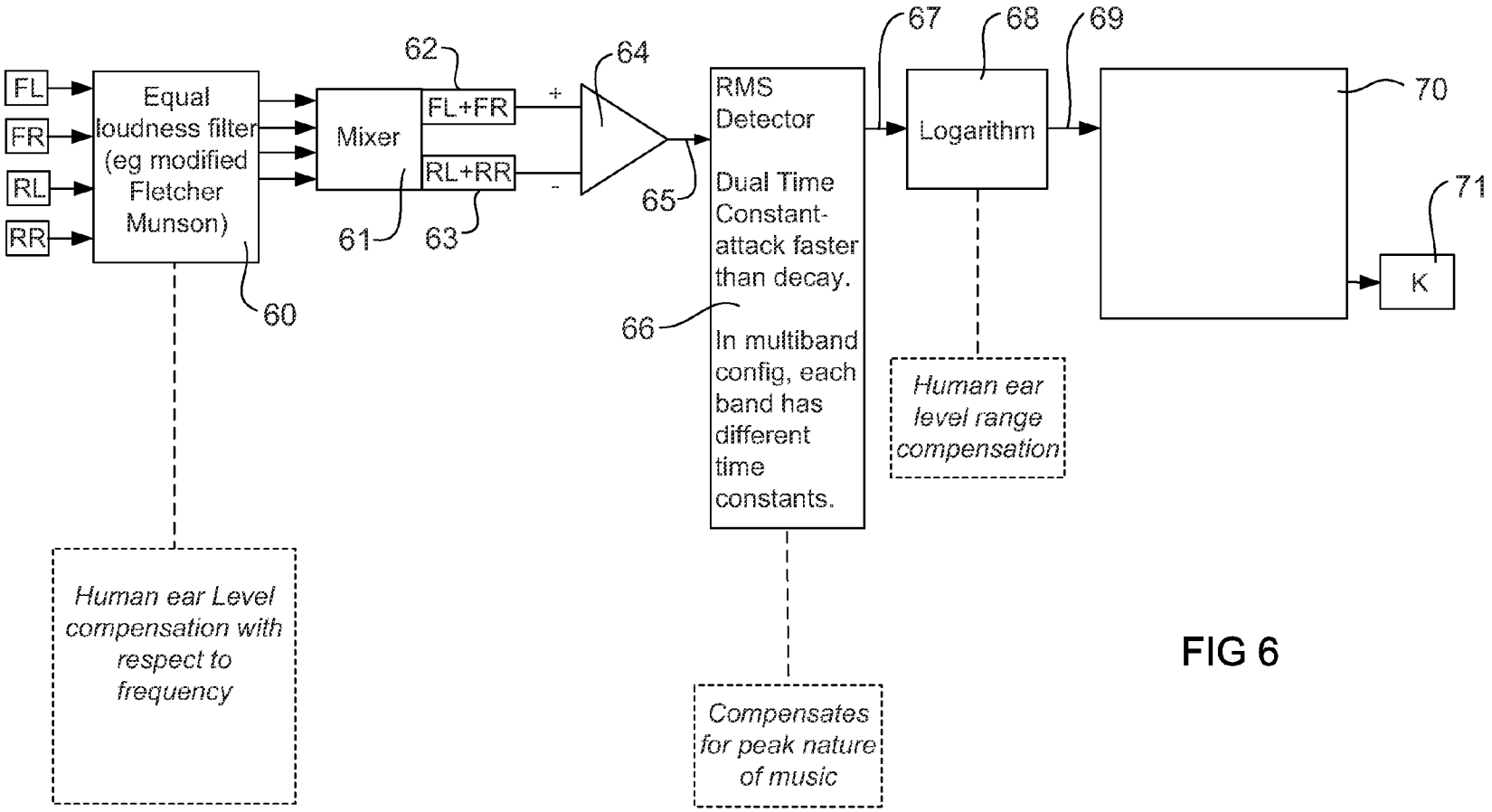
FIG. 6 shows a block diagram of logic associated with an encoder according to an embodiment of the present invention.

FIG. 6 is a block diagram of a logic circuit for dynamically varying the matrix coefficient k. The logic circuit is suitable for steering a matrix encoder dynamically based on quantity of rear or surround signal content relative to front signal content. The dynamic logic circuit includes an equal loudness weighting filter 60 such as a modified Fletcher Munson/A-weighting or ITU-R 468 filter for providing compensation for variations in perceived loudness relative to frequency due to non linearity in human hearing response at least at some frequencies. The equal loudness weighting filter may be modified to include a characteristic similar to a pink noise (1/f) weighting at low frequencies, to further attenuate high amplitude low audibility sounds that may otherwise unduly influence the steering logic circuit.

One reason for the compensation is that sounds in a 2-4 KHz octave appear loudest to the ear whilst sounds at other frequencies appear attenuated. A-weighting filters are sometimes used for the purpose of compensation. However, a pink noise filter is preferred for music content over an A-weighting filter because the latter is mainly valid for pure tones and relatively quiet sounds.

Pink noise is also known as 1/f noise, wherein power spectral density is inversely proportional to frequency. A pink noise contour gives greater attenuation at low frequencies than a Fletcher Munson/A-weighting or ITU-R 468 weighting filter based on the fact that for equal power, amplitude is inversely proportional to frequency. Use of a pink noise contour may further reduce dominance of low frequency sounds (high amplitude but low audibility) in calculating steering logic values, which are based on amplitude, and results in better placement of sound information that may be important for correct image generation.

The dynamic logic circuit includes a mixer 61 for adding the compensated channel signals FL and FR to produce front sum signals (FL+FR) 62 and rear sum signals (RL+RR) 63, and comparator 64 for subtracting the two sum signals 62,63 to produce a difference signal (FL+FR)−(RL+RR) 65. The difference signal 65 is applied to RMS detector 66. RMS detector 66 is adapted to compensate for the peak nature of music content. The averaging time constant over which RMS detector 66 measures a 'mean' value of a music signal preferably includes a first or 'attack' time constant and a second or 'decay' time constant. The 'attack' time constant may be substantially faster than the 'decay' time constant. In one example the attack time constant may be 20 mS and the decay time constant may be 50 mS for a full range RMS detector. In some embodiments an RMS detector including a single time constant may be used.

RMS detected output 67 is applied to logarithmic amplifier 68 to produce output 69 proportional to log|(FL+FR)−(RL+RR)|. Logarithmic amplifier 68 is adapted to correct for logarithmic sensitivity of human hearing response to sound that spans a range of signal amplitudes or levels. Output signal 69 is applied to scaling circuit 70 to produce a scaled value 71 of transformation or matrix coefficient k based on a comparison of RMS detected and corrected signals 62 and 63. In one form scaled value 71 may vary between 0.1 and 0.414 representing a 20 dB range between signals 62 and 63.

Figure 1:
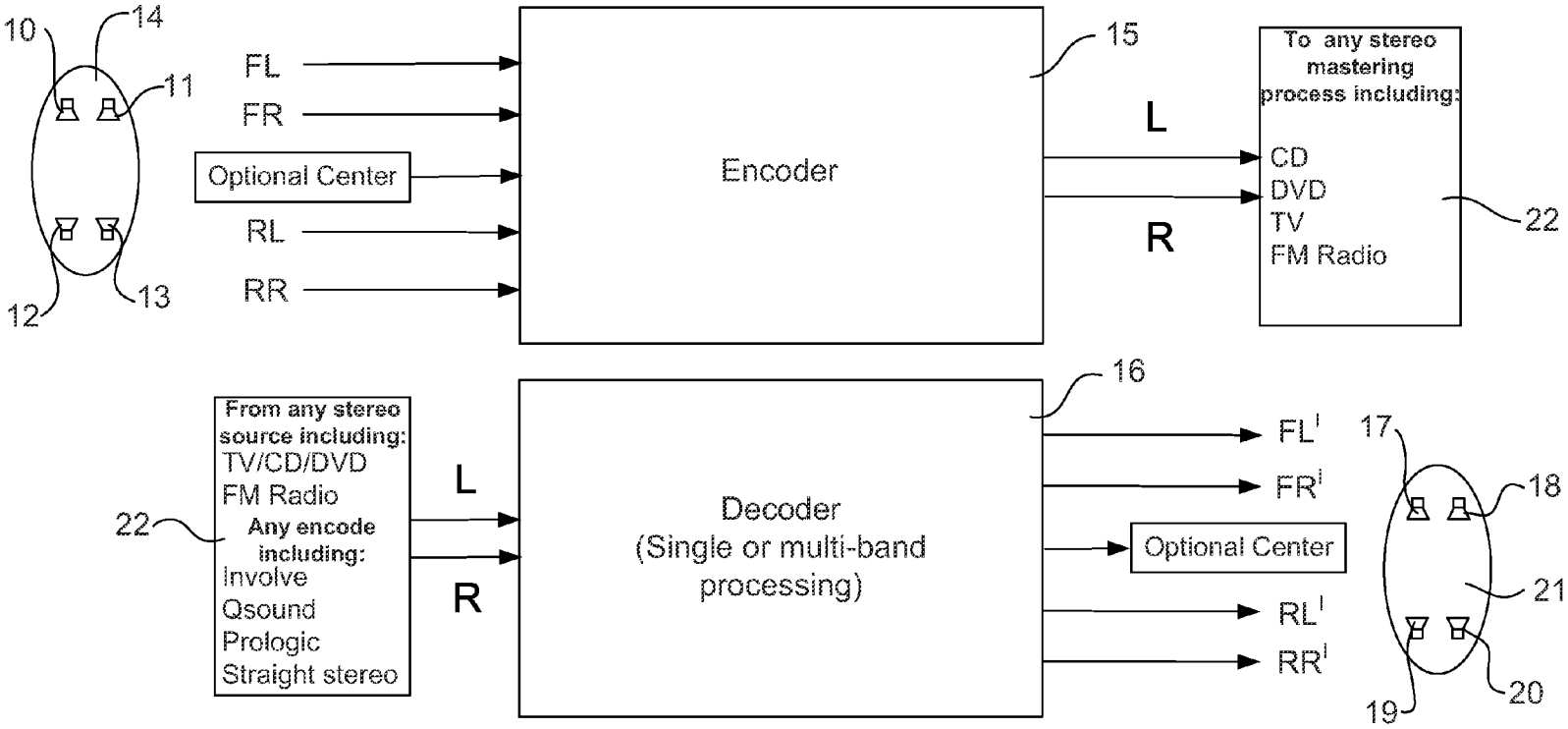
FIG. 1 is a block diagram showing principles of a "4-2-4" matrix system.
Figure 2:
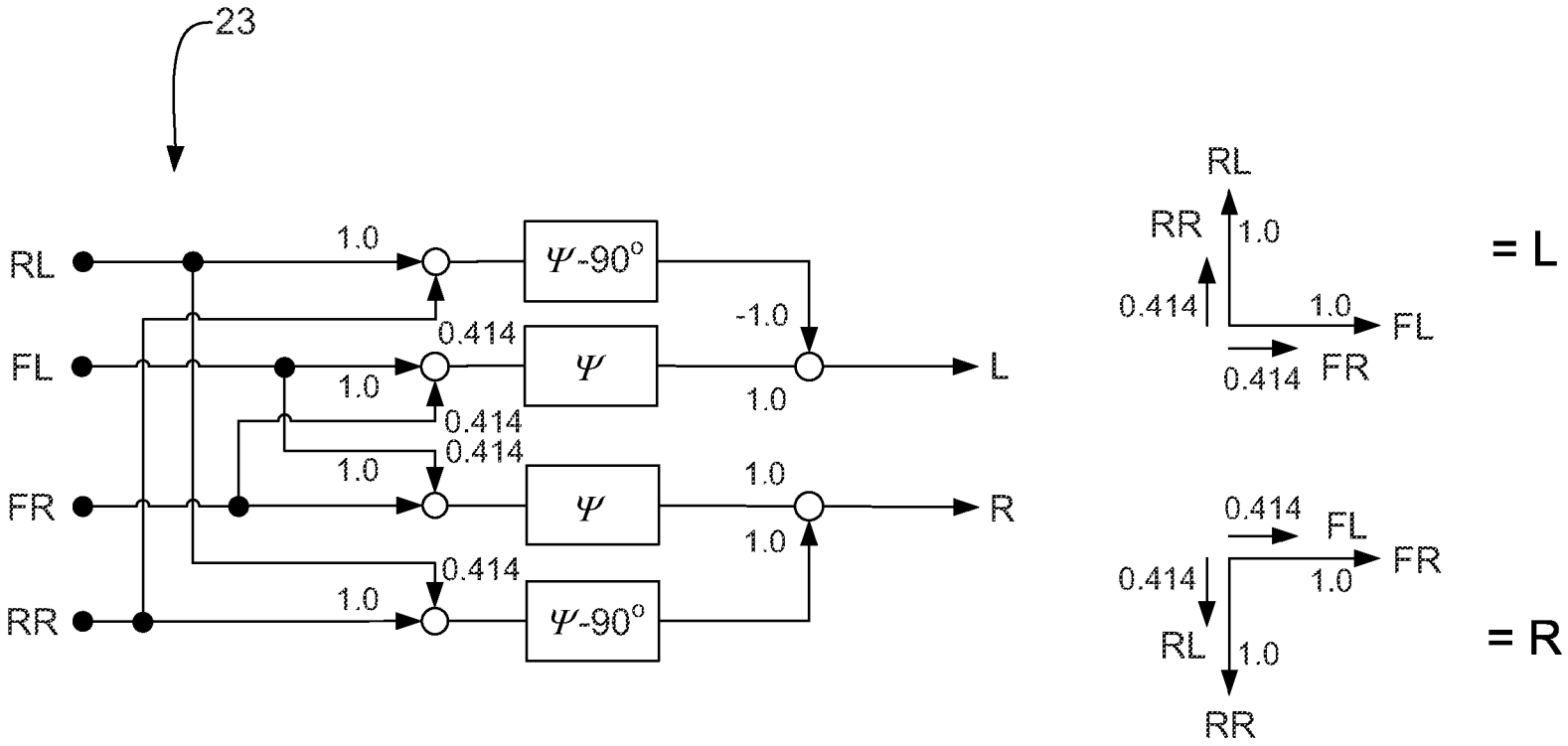
FIG. 2 shows a configuration of a conventional encoder.
Figure 3:
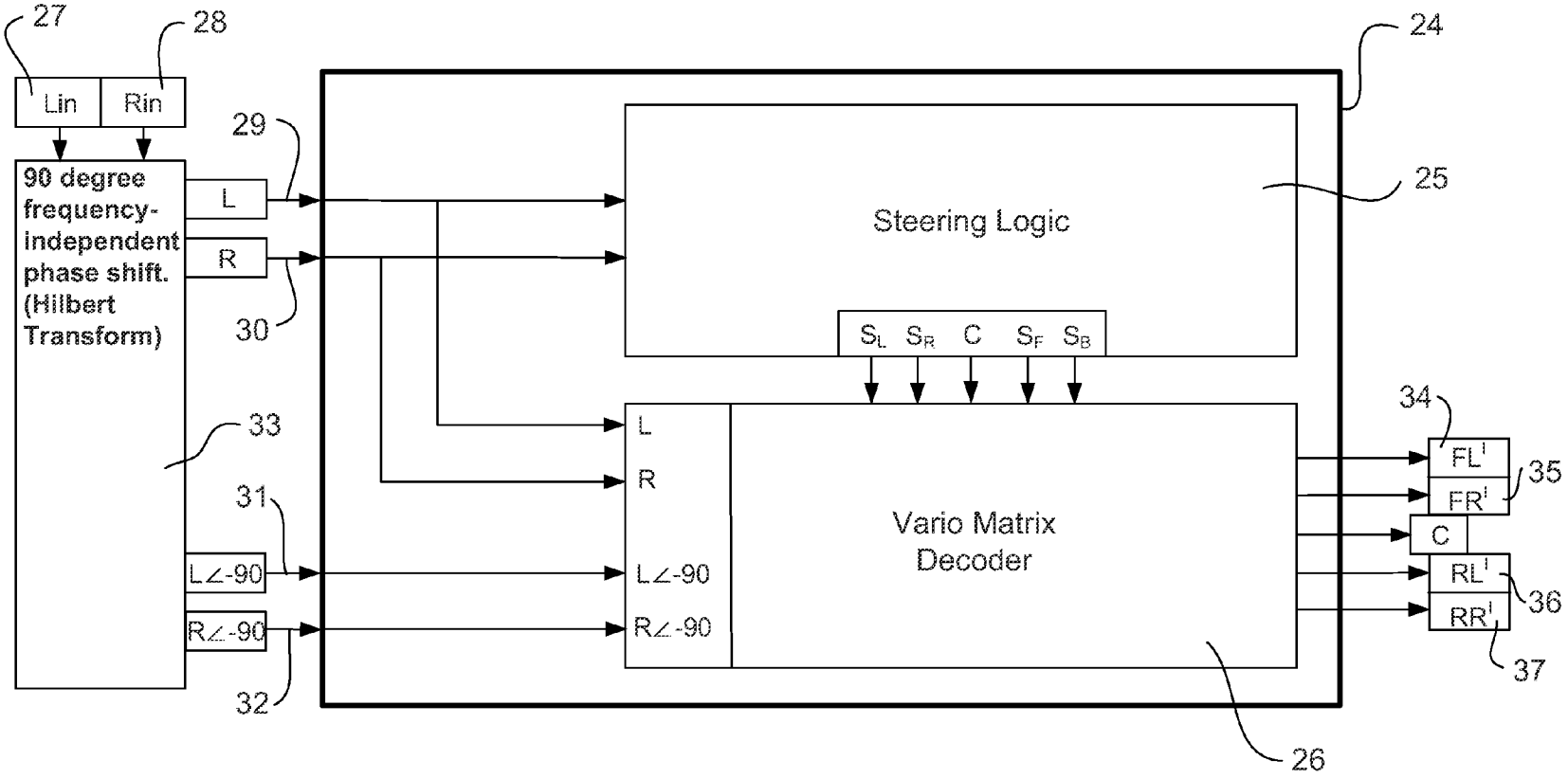
FIG. 3 shows a block diagram of a decoder including a variable matrix.
Figure 4:
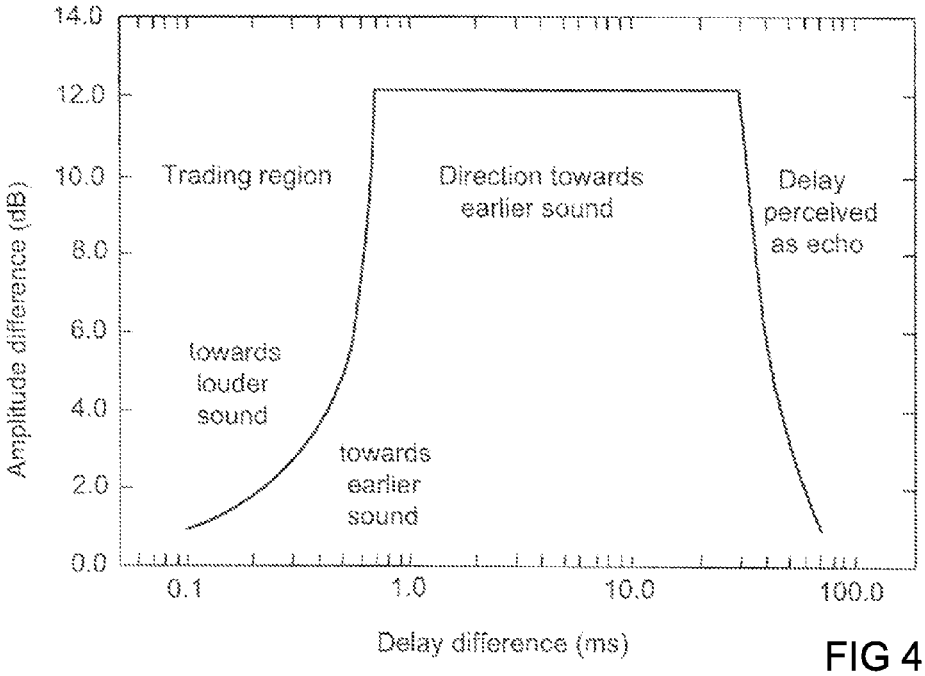
FIG. 4 shows a graph of amplitude difference (dB) versus delay difference (mS) for illustrating the HAAS or precedence effect.
Figure 7:
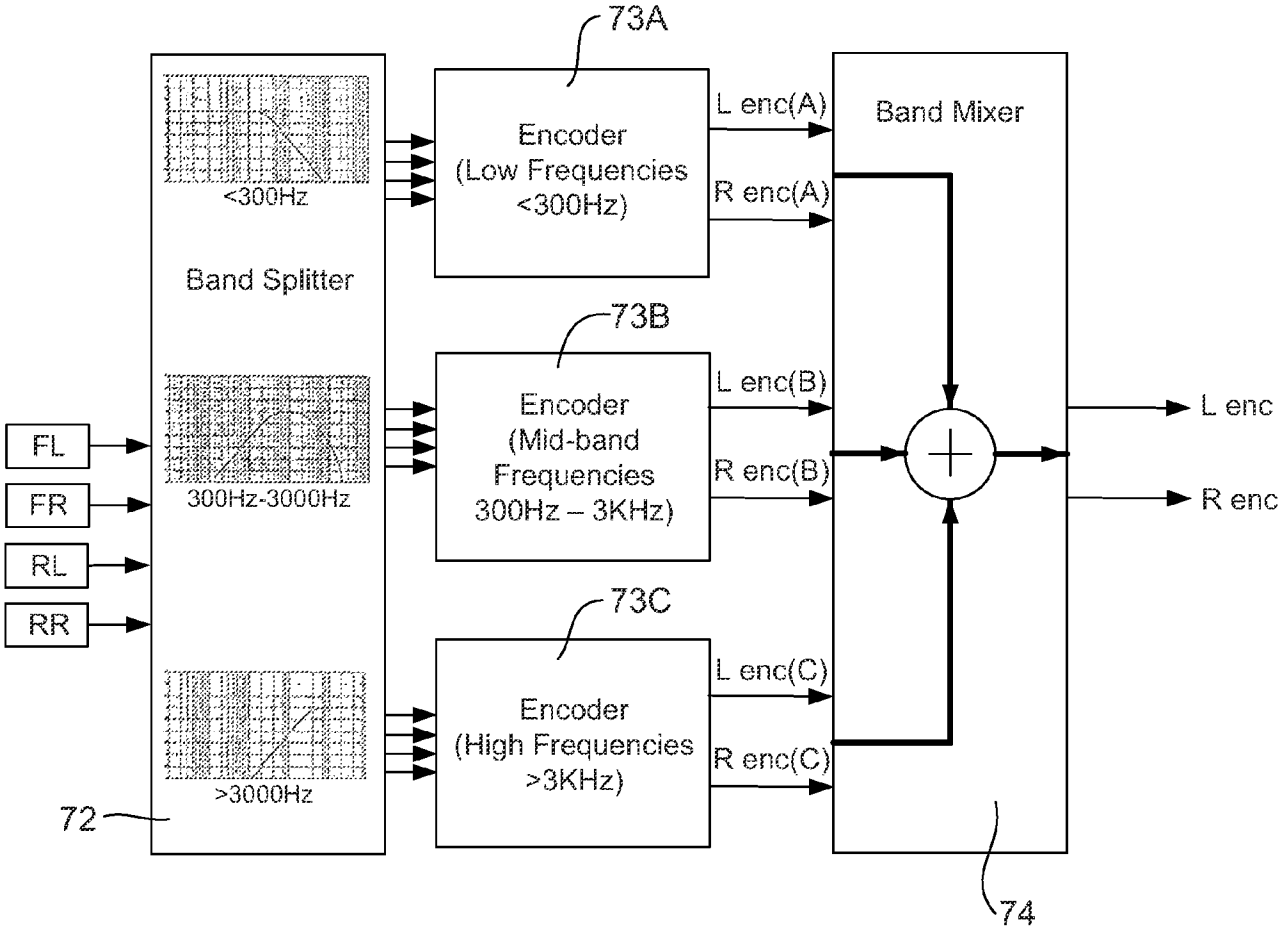
FIG. 7 shows a block diagram of a multi-band encoder according to an embodiment of the present invention.

Because it may be difficult to optimize scaled value 71 for all frequencies present in music content, high and low frequency sounds may be scaled differently resulting in an unnatural reproduction of sounds for the listener. To mitigate against this the encoder of the present invention may include a multi-band modification as shown in FIG. 7. FIG. 7 shows a multi-band encoder wherein the audible spectrum may be split into 3 separate bands via band splitter 72. The bands include a low frequency band A below 300 Hz, a mid-frequency band B between 300-3 KHz and a high frequency band C above 3 KHz. Band splitter 72 may be interposed between input signals FL, FR RL, RR and a variable matrix encoder comparable to encoder 15 (refer FIG. 1). A separate matrix encoder 73A, 73B, 73C may be used to produce a set of encoded output signals $L_{enc}$ and $R_{enc}$ for each frequency band A, B, C. The four channel output signals for each band may be subsequently combined via band mixer 74. The output $L_{enc}$ may be obtained by combining contributions $L_{enc}$ (A), $L_{enc}$ (B), $L_{enc}$ (C) produced by matrix encoders 73A, 73B and 73C respectively. The output $R_{enc}$ may be obtained by combining contributions $R_{enc}$ (A), $R_{enc}$ (B), $R_{enc}$ (C) produced by matrix encoders 73A, 73B and 73C respectively.

When RMS detector 66 is used in a multiband decoder the attack time constant may be 30 mS and the decay time constant may be 60 mS for band A. For band B the attack time constant may be 10 mS and the decay time constant may be 30 mS. For band C the attack time constant may be 1 mS and the decay time constant may be 5 mS.

Figure 8:
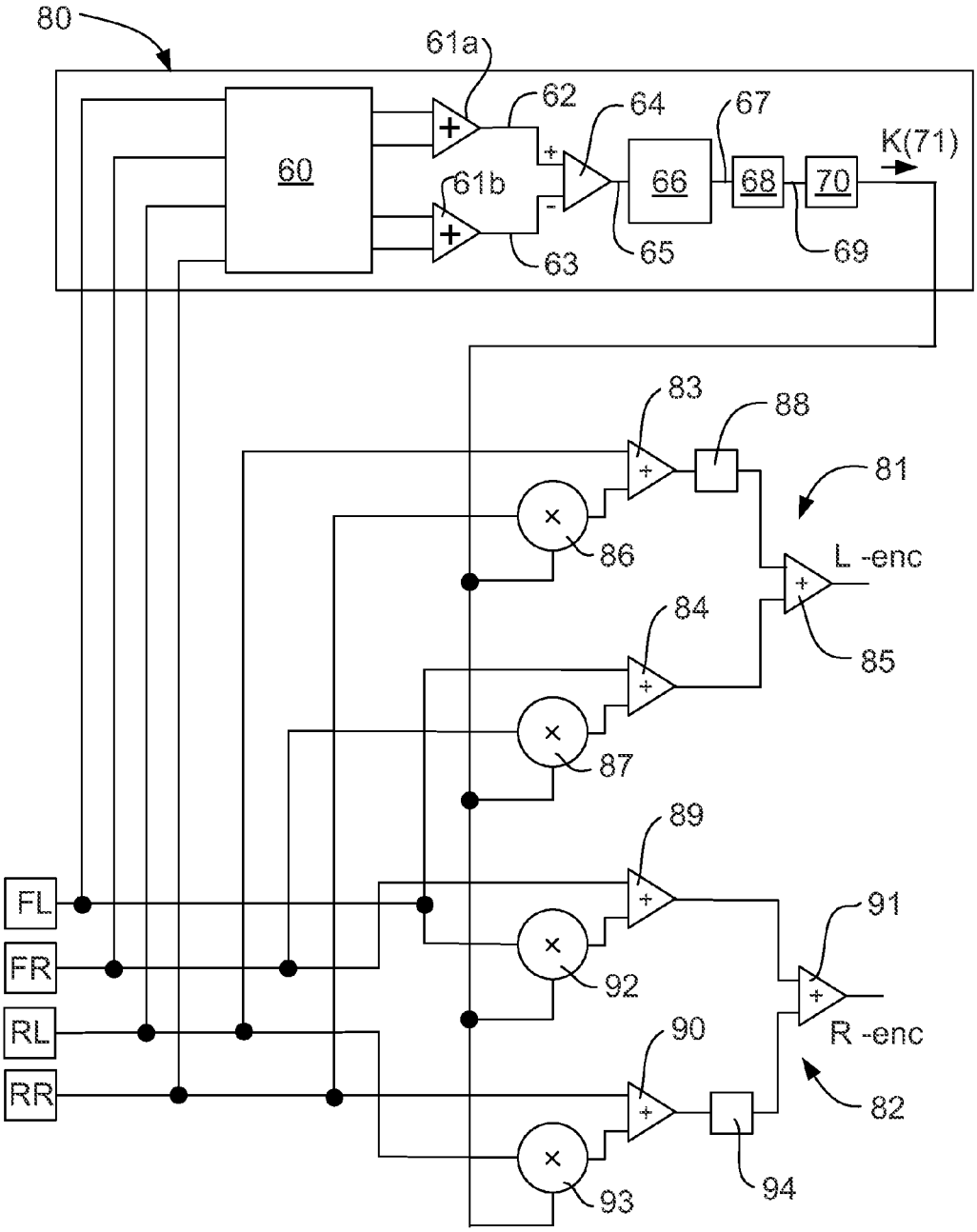
FIG. 8 shows a circuit diagram of a matrix encoder according to an embodiment of the present invention.

FIG. 8 shows a circuit diagram of a dynamic matrix encoder wherein the transformation or matrix coefficient k has a value that may be steered dynamically depending on the level of surround or rear signal content (RL+RR) that is present relative to front signal content (FL+FR).

The matrix encoder includes a dynamic logic circuit 80 for steering values of coefficient k between 0.1 and 0.414, and matrix circuits 81 and 82. Dynamic steering logic circuit 80 includes an equal loudness weighting filter 60 such as a modified Fletcher Munson filter, mixers 61*a*, 61*b*, comparator 64, RMS detector 66, logarithmic amplifier 68 and scaling circuit 70 as described above with reference to FIG. 6. Comparator 64 includes a differential circuit for producing a difference (FL+FR)−(RL+RR) signal 65 as described above. RMS detector 66 has dual time constants as described above. Scaling circuit 70 may be implemented in software and/or hardware and may convert input logarithmic signal difference 69 to ramp values as illustrated in FIG. 9.

Figure 9:
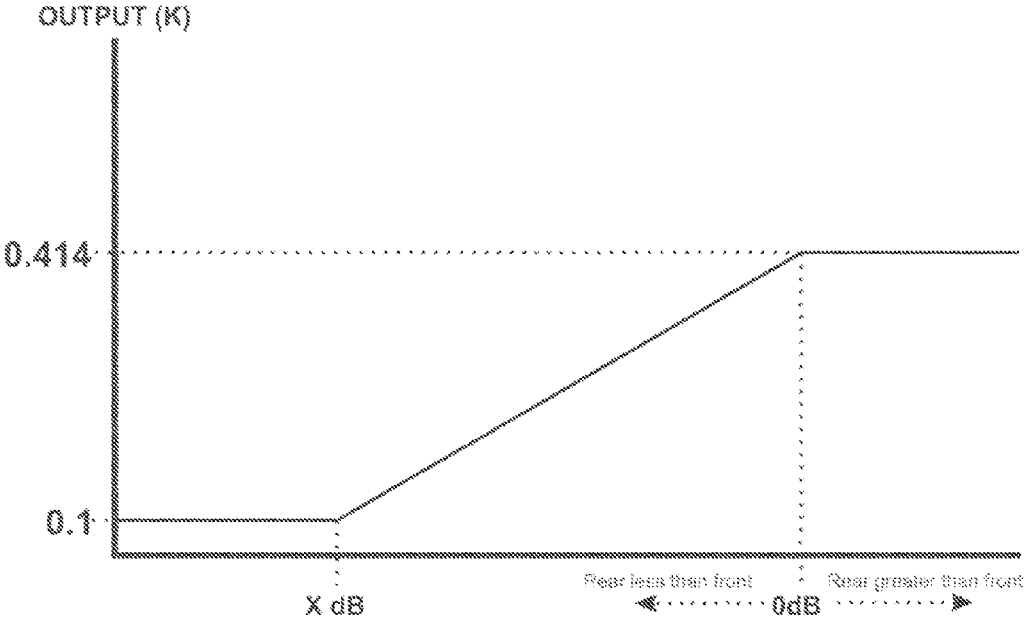
FIG. 9 shows a graphical representation of scaled values of k obtained from a scaling circuit.

In FIG. 9 the horizontal axis represents in dB, levels of surround or rear signal content (RL+RR) relative to front signal content (FL+FR). Thus the 0 dB point or level on the horizontal axis represents a balance between or equal front and rear signal content. Typically the X dB point or level on the horizontal axis may be substantially —12 dB relative to front signal content but in some circumstances may be other than —12 dB and may be determined based upon architecture of an implementation and/or discretion.

In FIG. 9 the vertical axis represents scaled or dynamic values 71 of k. It may be seen that k has a first or minimum value of 0.1 when the relative signal content on the horizontal axis is X dB or lower and has a second or maximum value of 0.414 when the relative signal content on the horizontal axis is 0 dB or greater. It may also be seen that the value of k increases substantially linearly from the first value 0.1 to the second value 0.414 as relative signal content on the horizontal axis increases from XdB to 0 dB.

Matrix circuit 81 includes summing amplifiers 83, 84, 85, multipliers 86, 87 and 90° phase shift circuit 88. The output $L_{enc}$ appearing at the output terminal of summing amplifier 85 and hence at the output of matrix circuit 81 is given by the following equation:

$$L_{enc}=FL+kFR+j(RL+kRR)$$

Matrix circuit 82 includes summing amplifiers 89, 90 difference amplifier 91, multipliers 92, 93 and 90° phase shift circuit 94. The output $R_{enc}$ appearing at the output terminal of summing amplifier 91 and hence at the output of matrix circuit 82 is given by the following equation:

$$R_{enc}=FR+kFL-j(RR+kRL)$$

Figure 10A:
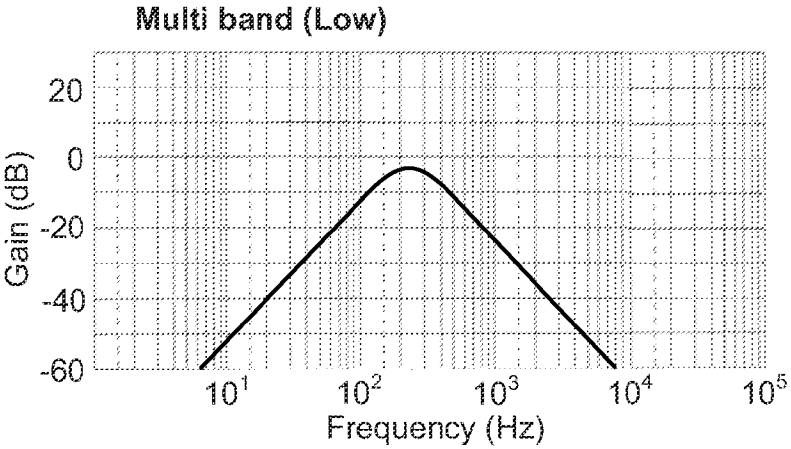
FIGS. 10A to 10D show examples of equal loudness response curves associated with a weighting filter.
Figure 10B:
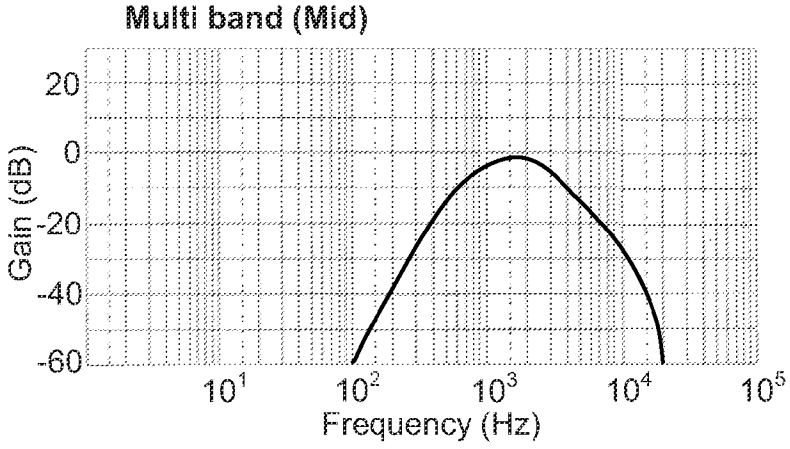
Figure 10C:
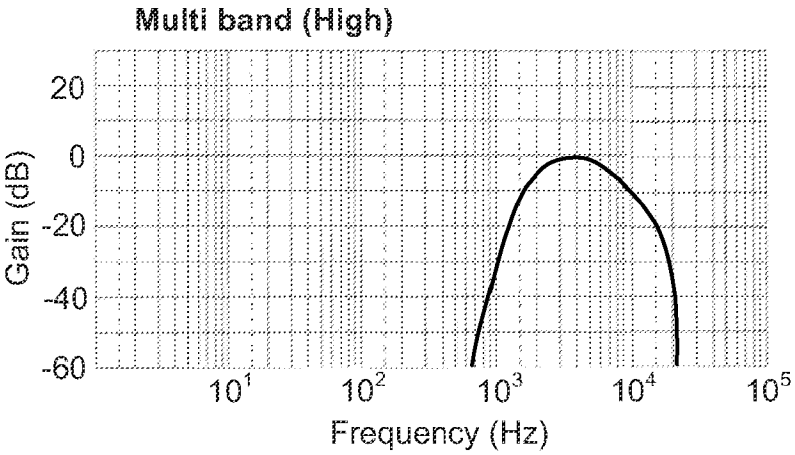
Figure 10D:
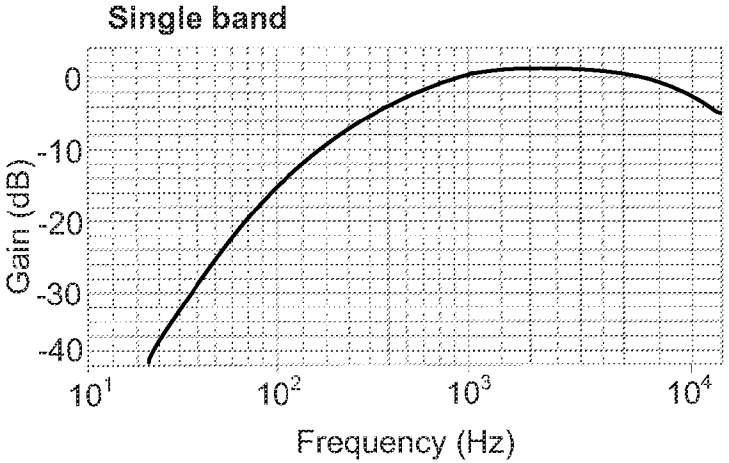

Equal loudness weighting filter 60 may include a modified Fletcher Munson -pink noise weighting filter including an ITU-R 468 weighting contour. Weighting filter 60 may be implemented in any suitable manner and by any suitable means. In one form the response of weighting filter 60 may include a frequency response contour as shown in FIG. 10D for a single band implementation. For multi-band implementations the response of weighting filter 60 may include frequency response contours as shown in FIGS. 10A to 10C for low band A, mid band B and high band C respectively.

RMS detector 66 may be implemented in any suitable manner and by any suitable means. In one form RMS detector 66 may be implemented on a digital sound processor such as a Texas Instruments TAS 3108 via Pure Path Studio Software.

The invention described herein is susceptible to variations, modifications and/or additions other than those specifically described and it is to be understood that the invention includes all such variations, modifications and/or additions which fall within the spirit and scope of the above description.

It may be appreciated that a matrix encoder as described herein may be applied to a surround sound system utilizing more than four audio input signals to represent an original sound field. For example using the teachings of the present invention a pair of encoders as described herein may be applied to encode eight audio input signals representing an original sound field into four channel signals and the encoded four channel signals may be decoded into eight audio output signals. Such encoders may be applied to an installation including four pairs of loudspeakers or speaker arrays wherein each loudspeaker or speaker array is arranged at a respective corner of a cube or a rectangular cuboid to define upper and lower planes of four loudspeakers or speaker arrays each, namely four loudspeakers or speaker arrays in the front and four loudspeakers or speaker arrays in the back. The upper plane of loudspeakers or speaker arrays may be vertically separated relative to the lower plane of loudspeakers or speaker arrays by approximately 2-3 m or other suitable distance depending on usable height in an associated listening zone or auditorium.

The encoded four channel signals may be recorded on suitable media such as DVD, BluRay disc or the like and/or broadcast via a HDTV transmission service such as Foxtel that is capable of transmitting at least four channels of audio signals.

The invention claimed is:

1. An encoder for use in a surround sound system wherein at least four audio input signals (FL, FR, RL, RR) representing an original sound field are encoded into two channel signals (L, R) and said encoded two channel signals are decoded into at least four audio output signals (FL', FR', RL', RR') corresponding to said four audio input signals, said encoder including:

matrix means connected to receive said four audio input signals for encoding said four input signals into two channel (L and R) output signals, said matrix means including means responsive to said four input signals for producing $L_{enc}$ and $R_{enc}$ output signals as follows:

$$L_{enc}=FL+kFR+jRL+jkRR$$

$$R_{enc}=FR+kFL-jRR-jkRL$$

wherein k denotes a transformation or matrix coefficient having a value that is steered dynamically based on level of rear signal (RL+RR) content relative to front signal (FL+FR) content.

2. An encoder according to claim 1 wherein the coefficient k is steered from a first value to a second value.

3. An encoder according to claim 2 wherein the coefficient k is steered between said first and second values substantially linearly.

4. An encoder according to claim 1 wherein the coefficient k has a first value that is substantially 0.1.

5. An encoder according to claim 1 wherein the coefficient k has a second value that is substantially 0.414.

6. An encoder according to claim 1 wherein said matrix means includes a plurality components selected from adders, multipliers, 90° phase shifters and comparators.

7. An encoding method for use in a surround sound system wherein at least four audio input signals (FL, FR, RL, RR) representing an original sound field are encoded into two channel signals (L, R) and said encoded two channel signals are decoded into at least four audio output signals (FL', FR', RL', RR') corresponding to said four audio input signals, said encoder including:

processing said four audio input signals into two channel (L and R) output signals, by matrix means responsive to said four input signals for producing $L_{enc}$ and $R_{enc}$ output signals as follows:

$$L_{enc}=FL+kFR+jRL+jkRR$$

$$R_{enc}=FR+kFL-jRR-jkRL$$

wherein k denotes a transformation or matrix coefficient and wherein said processing includes steering the value of coefficient k based on level of rear signal (RL+RR) content relative to front signal (FL+FR) content.

8. An encoding method according to claim 7 wherein the coefficient k is steered between said first and second value to a second value.

9. An encoding method according to claim 8 wherein the coefficient k is steered between said first and second values substantially linearly.

10. An encoding method according to claim 7 wherein the coefficient k has a first value that is substantially 0.1.

11. An encoding method according to claim 7 wherein the coefficient k has a second value that is substantially 0.414.

* * * * *